United States Patent [19]

Reed

[11] Patent Number: 4,491,176

[45] Date of Patent: Jan. 1, 1985

[54] ELECTRIC POWER SUPPLYING WELL HEAD ASSEMBLY

[76] Inventor: Lehman T. Reed, 3505 Chester Ave., Bakersfield, Calif. 93301

[21] Appl. No.: 432,300

[22] Filed: Oct. 1, 1982

[51] Int. Cl.[3] ..... E21B 33/03

[52] U.S. Cl. ..... 166/65 R; 166/85; 166/88; 339/60 C

[58] Field of Search ..... 166/65 R, 85, 88, 89; 339/15, 16 RC, 16 C, 16 R, 60 C, 117 R

[56] References Cited

U.S. PATENT DOCUMENTS

| | | | |
|---|---|---|---|
| 3,223,168 | 12/1965 | Stone | 166/89 |
| 3,489,439 | 1/1970 | Word, Jr. | 166/89 |
| 3,638,732 | 2/1972 | Huntsinger et al. | 166/65 R |
| 3,739,846 | 6/1973 | Beson | 166/89 |
| 3,871,734 | 3/1975 | Murtland | 339/15 |
| 4,154,302 | 5/1979 | Cugini | 166/65 R |
| 4,181,175 | 1/1980 | McGee et al. | 166/85 |
| 4,202,410 | 5/1980 | Quebe | 166/88 |
| 4,289,199 | 9/1981 | McGee | 166/65 R |

*Primary Examiner*—Stephen J. Novosad
*Assistant Examiner*—Hoang C. Dang
*Attorney, Agent, or Firm*—William C. Babcock

[57] ABSTRACT

A well head assembly that terminates on the upper end in a horizontal mounting flange on which the flange of a christmas tree array of valves may be sealingly mounted to control the flow of fluid from the well associated therewith, and the well head assembly including slidably engageable first and second electrical conducting cartridges below the mounting flange for supplying electric power to a number of insulated electrical conductors that extend downwardly in the well to an electric motor driven down hole pump or other electrical apparatus. The positioning of the christmas tree array of valves at a minimum height relative to the well head is most desirable in those situations where a number of wells are drilled close together, such as on an off shore island, and equipment must be periodically moved over the array of valves for maintenance or drilling purposes. The well head assembly also includes means for pressurizing a normally open pressure actuated valve in communication with a tubing string operatively associated with the assembly to place the valve in a closed position. Closing of the valve eliminates the possibility of continued undesired fluid discharge from the well in the event of a catastrophe or malfunctioning of the well.

11 Claims, 15 Drawing Figures

ELECTRIC POWER SUPPLYING WELL HEAD ASSEMBLY

BACKGROUND OF THE INVENTION

1. Field of the Invention

Electric Power Supplying Well Head Assembly.

2. Description of the Prior Art

In the past, well head assemblies have been devised and used that permit discharge of fluid from a well bore, as well as supplying electrical power to a electric motor driven down hole pump. Such a well head assembly is disclosed in U.S. Pat. No. 3,437,149 that issued on Apr. 8, 1969 to E. T. Cugini and Wallace S. Jeannerett.

The well head assembly in the Cugini patent has the operational disadvantage that the electric power supply conduit extends upwardly above the assembly and precludes a christmas tree array of valves being mounted directly on the assembly. As a result the array of valves is disposed a substantial distance above the Cugini well head assembly.

On wells that are drilled closely together, such as on off shore islands, christmas tree array of valves that have a high vertical profile are undesirable as equipment must be moved periodically over the array in the maintenance of the wells as well as further drilling operations.

A major object of the present invention is to supply a well head assembly that eliminates the operational disadvantage of the Cugini unit by allowing the christmas tree assembly of valves to be supported directly on the uppermost portion thereof, with the assembly including a first horizontal electrical conducting cartridge and second downwardly extending cartridge both of which are disposed below the uppermost portion of the assembly, and the cartridges slidably engaging one another to provide electric power to an electric motor actuated down hole pump.

A further object of the assembly is to support a tubing string in a centered downwardly extending position relative to a casing string, with the tubing string in communication with a normally open pressure actuated valve, and the casing head assembly defining a confined space that may be externally pressurized to actuate the valve to assume a closed position in the event of an emergency.

Another object of the invention is to supply a well head assembly that has a tubing hanger removably and rotatably supported therein with the first electrical conducting cartridge occupying a fixed but removable position, with the second cartridge supported from the tubing hanger, and the well head assembly including indexing means to dispose the tubing hanger in a predetermined position where the first and second cartridges may slidably engage one another to supply electric energy to a down hole pump or other electrical apparatus in the well bore.

A still further object of the invention is to furnish a well head assembly in which the tubing hanger supports the second electrical conducting cartridge in a position a substantial distance below a mounting flange with the second electrical conducting cartridge in a first form of the well head assembly being an integral part of the tubing hanger, and in a second form the second electrical conducting cartridge being removably supported from the tubing hanger.

Yet another object of the invention is to furnish a second electrical conducting cartridge in which the body thereof may be formed completely from a nonmetallic, corrosion resistant material that maintains a number of metallic electrical conductors associated therewith in spaced relationship, and eliminates the possibility of these conductors shorting out.

These and other objects of the invention will become apparent from the following description of preferred forms thereof.

SUMMARY OF THE INVENTION

The well head assemblies of the present invention are used in combination with a well bore that has at least one string of casing extending downwardly therein. An electric motor driven down hole pump is located in the bore hole at an appropriate depth, and has a string of tubing extending upwardly therefrom to terminate in an upper threaded end portion. An electric cable that includes a number of electrically insulated electrical conductors extends upwardly in the bore hole from the electric motor of the pump to terminate in an upper end.

The flow of fluid from the bore hole is controlled by a conventional christmas tree array of valves, which array has a lower supporting flange that has a vertical passage therein through which well fluid may flow upwardly.

Each of the well head assemblies of the present invention not only permits electric power to be supplied to the electric motor driven down hole pump, but so supports a christmas tree array of fluid controlling valves that the array will have a minimum height above the well head assembly. Such minimum height is most desirable on wells that are drilled close together, such as on off shore islands, for equipment must be periodically moved over the array of valves on each well in conjunction with maintenance work and further drilling operations.

First and second forms of a well head assembly are disclosed and claimed in the present application. Each of the forms of the well head assembly includes a heavy walled tubular well head member, secured to the upper end of a string of casing, and the tubular well head member held at a fixed location relative to the ground surface by conventional means. The tubular well head member has interior and exterior cylindrical surfaces, an upper end surface, and a transverse bore that extends between the interior and exterior surfaces intermediate the upper and lower end surfaces of the tubular well head member. The transverse bore serves to slidably and sealingly receive a first electrical conducting cartridge that has a number of inwardly disposed, electrical conducting, engaging members that are insulated from one another, and the first cartridge being connected to a source of electric power.

A cylindrical tubing hanger is rotatably and sealingly disposed in the well head member, with the tubing hanger including a top surface, bottom surface, and a generally cylindrical side surface, with the tubing hanger having a centered bore extending upwardly and longitudinally therethrough. The bore includes a lower threaded portion that engages the upper threaded end of the tubing string. A first passage is formed in the tubing hanger that extends upwardly from the bottom surface and intersects a second horizontal passage that is transversely disposed and extends inwardly from the side surface of the tubing hanger. The second passage and the transverse bore have center lines that lie in the same horizontal plane.

First means are provided in the tubular well head member for maintaining the cylindrical tubular hanger at a fixed longitudinal, rotatable position relative to the well head member. A second electrical conducting cartridge is disposed in the first passage and includes electrical conductors that have first engageable conductors extending into the second passage that may be removably engaged by the first electrical conducting cartridge, and second engageable electrical conductors that extend downwardly in the second passage and are engageable by engaging electrical conductors on a connector secured to the upper end of the electrical conducting cable.

In the first form of the invention, the second electrical conducting cartridge forms an integral part of the tubing hanger. In the second form of the well head assembly the second cartridge may be removed from the tubing hanger when desired for maintenance purposes or replacement. Indexing means are provided on both the first and second form of the assemblies for rotating the tubing hanger from the exterior of the assembly to the extent that the second passage is axially aligned with the transverse bore, and the first electrical conducting cartridge then capable of being moved inwardly to removably engage the second electrical conducting cartridge and furnish electric power through the cable to the electric motor that drives the down hole pump. The upper end of the tubular well head member has a mounting flange removably secured thereto on which a lower flange of the christmas tree array of valves is mounted to maintain the array of valves at a minimum vertical profile.

In either the first or second form of the well head assembly, the tubing string may have a normally open pressure actuated valve therein, and the well head assemblies having cooperating passages therein through which pressure may be exerted on the valve to close the same in an emergency to prevent upward flow of fluid through the tubing string.

DESCRIPTION OF THE PREFERRED EMBODIMENTS

Figure 1:
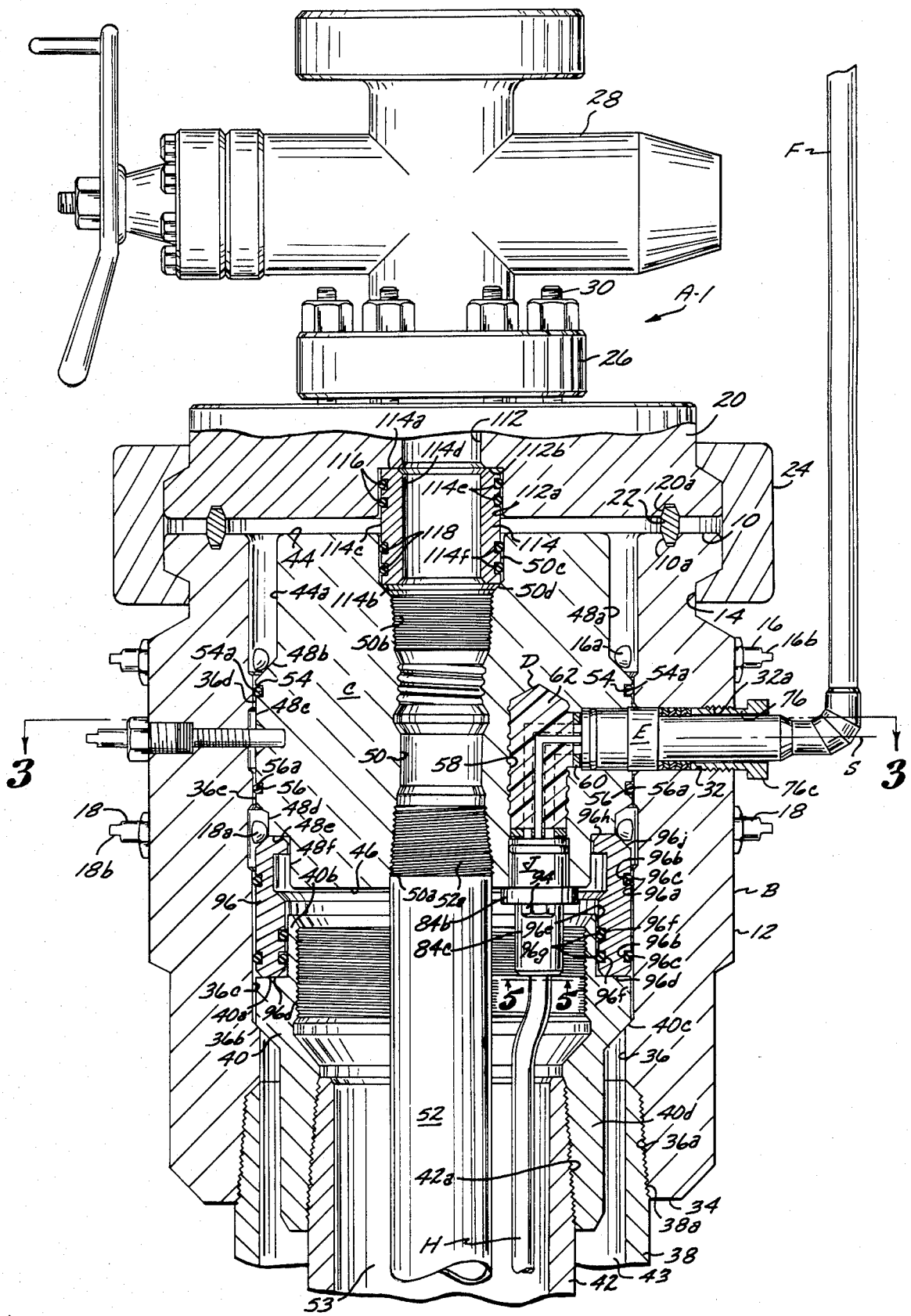
FIG. 1 is a longitudinal cross sectional view of a first form of the well head assembly, in which the second cartridge is formed as an integral part of the tubing hanger.

A first form A-1 of the well head assembly is illustrated in FIG. 1 and in FIGS. 3 to 6 inclusive. The well head assembly A-1 includes a heavy walled tubular well head member B that is maintained at a fixed location relative to the ground surface by conventional means (not shown). The well head member B has a flat ring shaped top surface 10 in which a circumferentially extending groove 10*a* is formed.

A well head member B has a generally cylindrical exterior side surface 12 that has a circumferentially extending recess 14 formed in the upper portion thereof.

An upper set of circumferentially spaced radially extending threaded rods 16 are rotatably supported in transverse tapped bores (not shown) in the well head member B, with each rod including an inner end portion 16*a* and an outer end portion 16*b* that is engageable by a wrench (not shown) for rotating the rod. A lower set of circumferentially threaded rods 18 that are radially disposed are rotatably supported in transverse tapped bores (not shown) defined in the tubular well member B, with each of the rods having an inner end 18*a* and an outer end 18*b* that is wrench engageable to permit rotating the rod.

A mounting flange 20 is provided as shown in FIG. 1 that has a ring shaped groove 20*a* formed in the lower surface thereof and vertically aligned with the groove 10*a*. The grooves 10*a* and 20*a* are engaged by a sealing ring 22. Conventional fastening means 24 removably engage the mounting flange 20 and the recess 14 as shown in FIG. 1 to sealingly maintain the mounting flange on the well head member B.

A first flange 26 that forms a part of a christmas tree valve supporting assembly 28 is mounted directly on the mounting flange 20 and removably secured thereto by bolts 30 as shown in FIG. 1. A transverse bore 32 is formed in the well head member B below the recess 14 as shown in FIG. 1, with the bore 32 having threads 32*a* defined in the outer portion thereof. The well head member B includes a ring shaped bottom 34 that has an interior surface 36 extending upwardly therefrom, with threads 36*a* on surface 36 being engaged by threads 38*a* on the upper end of an outer casing string 38 as shown in FIG. 1.

The interior surface 36 as best seen in FIG. 1 has a body shoulder 36*b* above threads 36*a*. The well head member B has an interior cylindrical wall section 36 defined therein above the body shoulder 36*b*. Upper and lower interior wall sections 36*d* and 36*e* are also defined above the wall section 36*c* as shown in FIG. 1.

A casing hanger 40 is mounted within the well head member B and is in the form of a generally cylindrical shell, which shell includes a horizontal ring shaped abutment 40*a* from which a first internally threaded tubular portion 40*b* extends upwardly. The casing hanger 40 as shown in FIG. 1 includes a downwardly and inwardly tapered portion 40*c* that rests on the body shoulder 36*b*. The casing hanger 40 also includes a second internally threaded portion 40*d* as shown in FIG. 1 that engages threads 42*a* defined on the upper end of an inner casing string 42 that is separated from the outer casing 38 by an annulus shaped space 53.

A tubing hanger C as may be seen in FIG. 1 is situated within the well head member B, which tubing hanger includes a top surface 44, and a bottom surface 46. The tubing hanger is further defined by an upper cylindrical side wall section of 48*a* that on its lower end develops into a downwardly and outwardly tapering first body shoulder 48*b*. The body shoulder 48*b* on the lower end develops into a cylindrical wall surface 48*c*, which wall surface on the lower end merges into a cylindrical wall section 48*d* of smaller diameter. The wall section 48*d* terminates on the lower end in an inwardly extending horizontal abutment 48*e* that has a cylindrical side wall section 48*f* extending downwardly therefrom to terminate in the bottom 46.

The tubing hanger C has a centered bore 50 extending upwardly and longitudinally therethrough, with the bore having a lower threaded portion 50*a* and an upper threaded portion 50*b* defined therein. An extension 50*c* of the bore 50 extends upwardly from the upper threaded portion 50*b* and is of smooth cylindrical configuration.

The lower threaded portion 50*a* of the bore 50 is engaged by the upper threaded end portion 52*a* of a tubing string 52 that extends downwardly therefrom in a centered position through the inner casing 42, and is separated therefrom by an annulus shaped space 53. A second electrical conducting cartridge D is provided that is best seen in detail in FIG. 6 and is an integral part of the tubing hanger C. The second cartridge D is defined by a first passage 58 that extends upwardly in tubing hanger D and has a lower cylindrical end section 58*a*. A second transverse passage 60 is formed in the tubing hanger C and intersects the first passage 58, with the second passage having an outwardly disposed cylindrical end section 60*a*.

Figure 6:
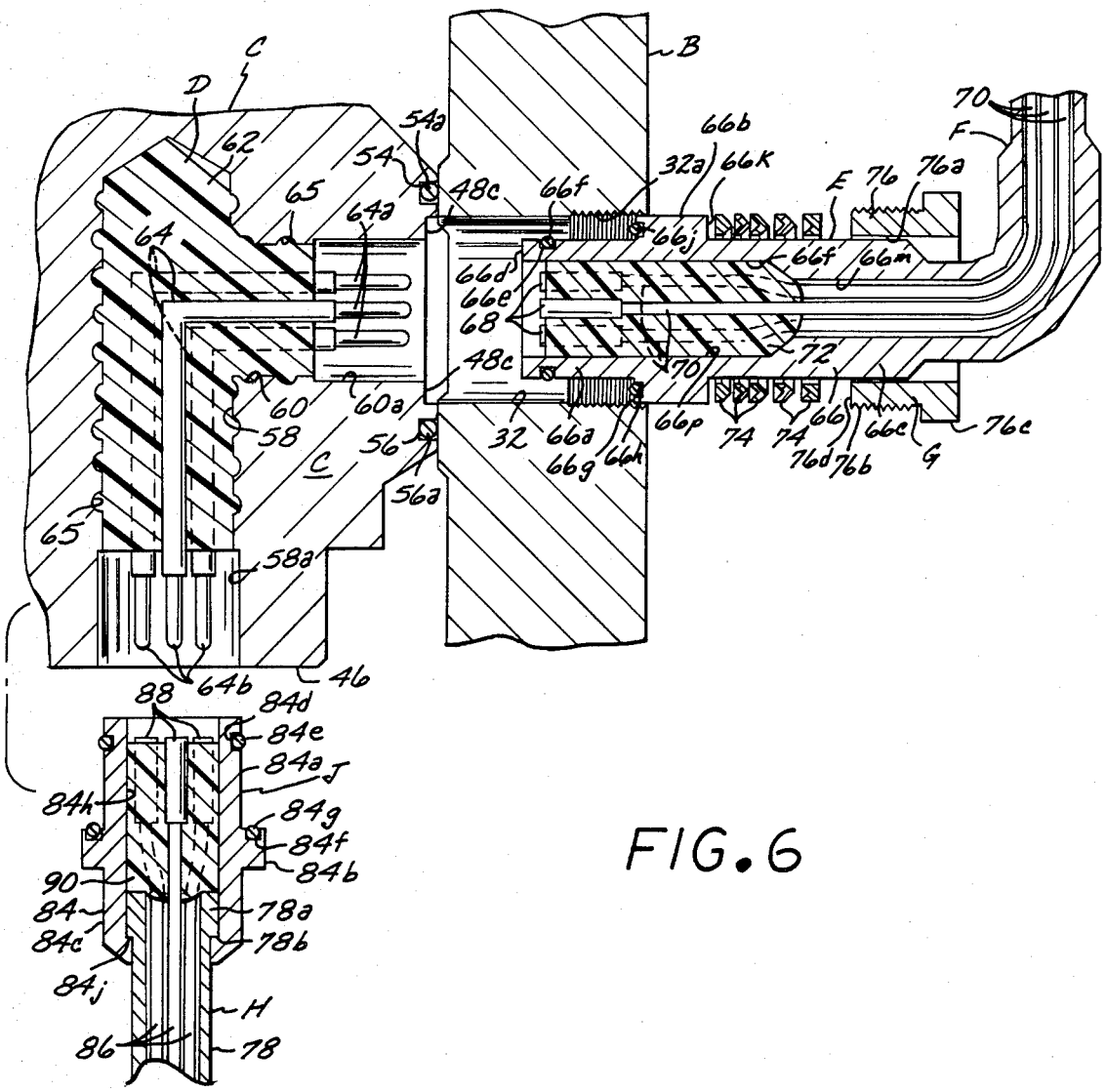
FIG. 6 is an exploded vertical cross sectional view illustrating the first electrical conducting cartridge connected to a source of power and slidably mounted in the transverse bore, of the electrical connector secured to the cable disposed below the tubing hanger, and a section of the tubing hanger being illustrated in which the second electrical cartridge is permanently positioned as an integral part thereof.

In FIG. 6 it will be seen that the first and second passages 58 and 60 are partially filled with a rigid electrical insulating material 62, such as an epoxy or the like, in which a number of electrical conductors of inverted L shaped configuration are embedded with the conductors having first engaging end portions 64*a* preferably in the form of prongs extending into the cylindrical end section 60*a*. The electrical conductors 64 also include engaging end portions 64*b* that extend downwardly into the cylindrical end section 58*a*. Grooves 65 are preferably formed in the portions of passages 58 and 60 in which the insulating material 62 is disposed to minimize movement of the material relative to the tubing hanger C.

A first electrical conducting cartridge E is provided as shown in FIGS. 1 and 6 that is defined by a generally cylindrical body 66 formed of an electrical insulating material, such as an epoxy or one of the commercially available polymerized resins. The body 66 includes a forwardly disposed cylindrical portion 66*a* that is of sufficiently small diameter as to be slipped inwardly through the transverse bore 32 formed in the well head member B.

The body 66 includes an intermediately disposed portions 66*b* that may snuggly and slidably engage the transverse bore 32, and the body 66 also including a rearward portion 66*c* of substantially smaller diameter than the intermediate portion 66*b*. The forward portion 66*a* has a transverse circumferentially extending groove 66*e* therein in which a sealing ring 66*f* is disposed. The forward portion 66*a* on the rearward end thereof develops into a body shoulder 66*g* of ring shaped configuration, which body shoulder has a groove 66*h* therein in which a resilient sealing ring 66*j* is disposed.

The intermediate portion 66*b* of the body 66 develops into a rearwardly disposed ring shaped body shoulder 66*k*. The body 66 has a longitudinal recess 66*p* therein that extends rearwardly from the forward end 66*d*, and the recess developing into a longitudinal extending bore 66*m* that is defined in the rearward portion 66*c*. A number of first engaging members 68, preferably in the form of electrical conducting sockets, are situated within the recess 66*p* and are in communication with a number of electrical conductors 70 that extend rearwardly to a cable F that is in communication with a source of electric power (not shown). The recess 66*p* as may be seen in FIG. 6 is filled with an electrical insulating material 72 such as an epoxy or the like. The rearward portion 66*c* of the body 60 has a number of resilient rings 74 of the chevron type mounted on the exterior surface thereof.

In FIG. 6 it will be seen that a collar G is provided that includes a tubular portion 76 that has a bore 76*a* extending longitudinally therethrough and threads 76*b* being formed on the exterior surface of the tubular portion 76. The rearward portion of the collar G has an enlarged wrench engageable portion 76c defined thereon, which wrench engageable portion permits the collar G to be rotated. The collar G has a forwardly disposed ring shaped end surface 76d.

An electrical conducting cable H extends upwardly in the annulus shaped space 53 shown in FIG. 1 from the motor driven down hole pump (not shown), with the cable as shown in FIG. 6 including an outer sheet 78 that terminates on the upper end in an enlarged portion 78a. The enlarged portion 78a has a lower body shoulder 78b the purpose of which will later be explained.

In FIG. 6 it will be seen that an electrical connector J is provided that is defined by a tubular shell formed from an electrical insulating material, which shell includes an upper cylindrical portion 84a and an intermediately disposed outwardly extending rib 84b. The shell includes a lower cylindrical portion 84c situated below the rib 84b. A circumferentially extending groove 84d is formed in the upper cylindrical portion 84a and has a resilient sealing ring 84e mounted therein. The rib 84b has a groove 84f extending downwardly from the upward surface thereof as shown in FIG. 6 in which a sealing ring 84g is disposed. A bore 84h extends upwardly through the shell 84 and in the lower portion develops into an inwardly extending ring shaped abutment 84j.

A number of insulated electrical conductors 86 are held in spaced relationship within the cable H, with the conductors having second engageable members 88 on the upper ends thereof as shown in FIG. 6. The second engaging members 88 are held in spaced relationship within the connector J by a body of electrical insulating material 90.

The rib 84b has a pair of spaced bores therein through which bolts 94 extend to engage tapped recesses (not shown) in the lower surface of 46 of the tubing hanger, and removably support the connector J from the tubing hanger C.

The well head assembly A-1 includes a retaining ring 96 best seen in FIG. 1 that has an external cylindrical surface 96a in which a pair of spaced circumferentially extending grooves 96b are defined that support a pair of resilient sealing rings 96c. The retaining ring has a bottom 96d and an interior surface 96e. A pair of spaced circumferentially extending grooves 96f are defined on the interior surface 96e, with the pair of grooves supporting resilient sealing rings 96g. The retaining ring includes a ring shaped top surface 96h from which a downwardly and outwardly tapered wall section 96j extends as shown in FIG. 1.

When the retaining ring 96 is disposed as shown in FIG. 1, and the threaded rods 18 rotated, the inner ends 18a of the rods pressure contact the tapered sections 96j of the retaining ring and force the same downwardly, with the downward force being exerted on the casing hanger 40 to force the latter into seating engagement with the body shoulder 36d of the well head member B.

When the tubing hanger C is disposed as shown in FIG. 1, the threaded members 16 when rotated have the inner ends 16a forced into pressure contact with the body shoulder 48b of the tubing hanger, and the center lines S of the second passage 60 and the transverse bore 32 now lying in the same horizontal plane. Although the second passage 60 and transverse bore 32 have the center lines S thereof in the same horizontal plane, the center lines may not be co-axially aligned.

An indexing device K is provided as a part of the well head assembly A-1 that permits limited rotation of the tubing hanger assembly C relative to the well head member B to the extent that the second passage 60 as shown in FIGS. 1 and 6 is co-axially aligned on a center line S with the transverse bore 32. Such alignment permits the first electrical conducting cartridge E to be moved inwardly to removably engage the second cartridge D as shown in FIG. 4.

Figure 3:
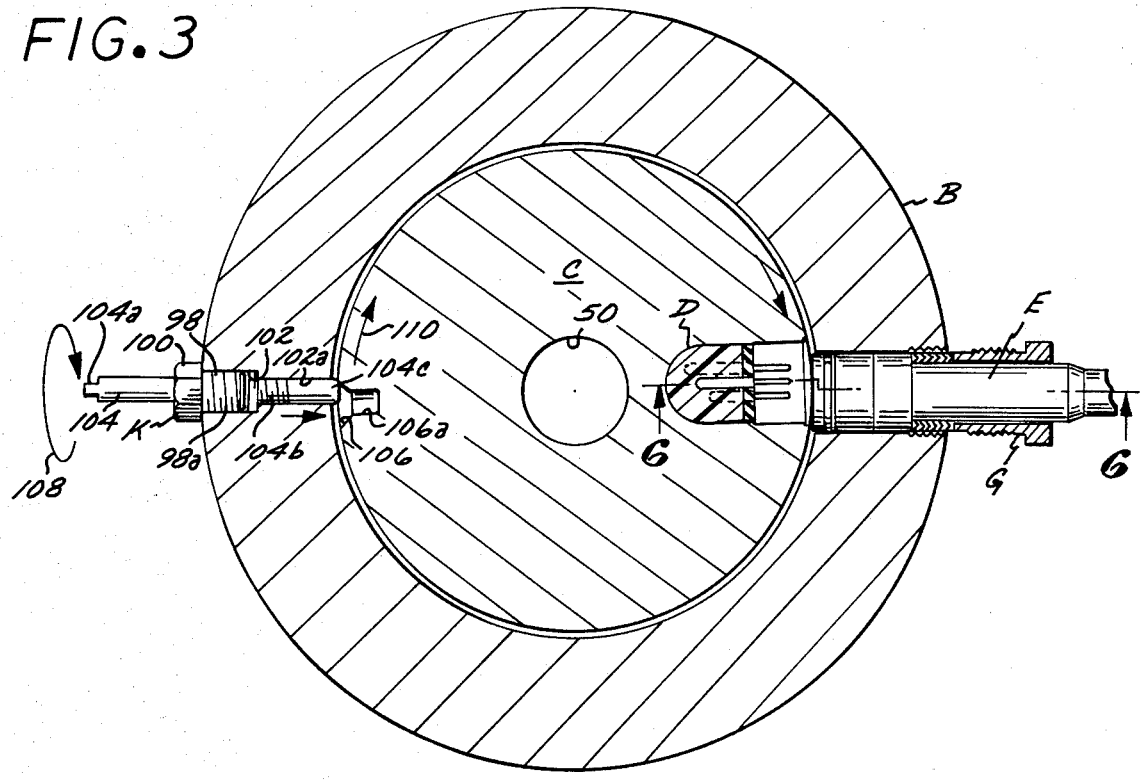
FIG. 3 is a transverse cross sectional view of the first form of well head assembly illustrated in FIG. 1 taken on the line 3—3 thereof, and illustrating the indexing means prior to the latter being actuated from the exterior of the assembly to rotate the tubing hanger to a position where the second passage and transverse bore are co-axially aligned.
Figure 4:
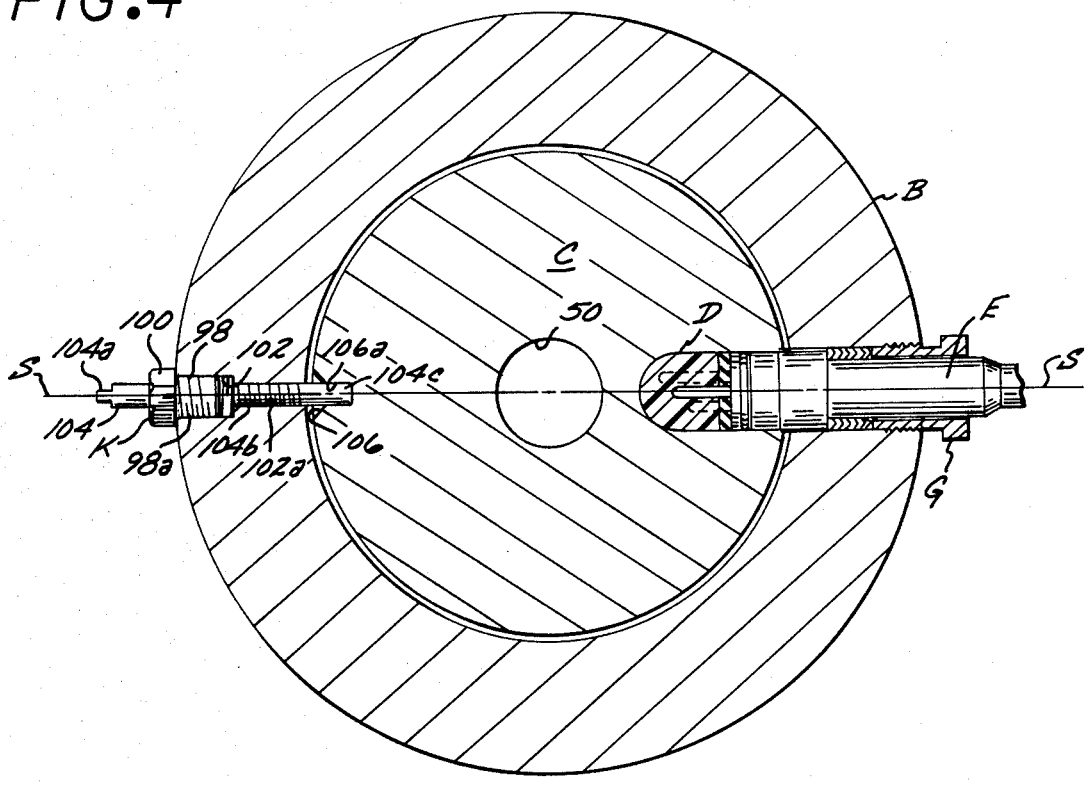
FIG. 4 is the same view as shown in FIG. 3 after the indexing has been completed, and the first cartridge having been moved inwardly into electrical communication with the second electrical conducting cartridge.
Figure 5:
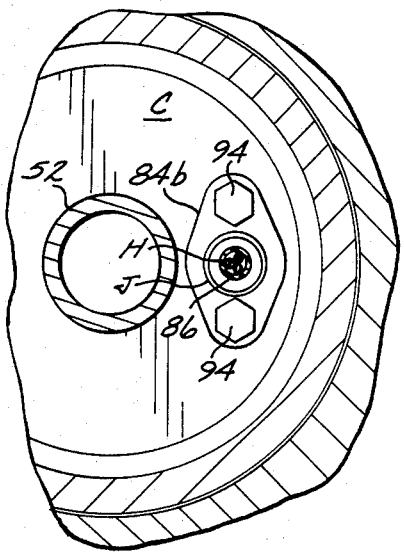
FIG. 5 is a combined horizontal cross sectional and bottom plan view of the connector secured to the upper end of the electric cable and taken on the line 5—5 of FIG. 1.

The indexing device K as best seen in FIGS. 3 and 4 includes a bushing 98 that has a wrench engageable outer end portion 100, and external threads formed on the bushing inwardly therefrom. The bushing has threads (not shown) formed on the interior thereof. The bushing 98 engages a tapped recess 102 in well head member B that is diametrically aligned with the bore 32. The tapped recess 102 on the inner end thereof develops into a transverse bore 102a in the well head member B that is also diametrically aligned with the bore 32. A rod 104 is provided that has a wrench engageable outer end 104a and intermediate externally threaded section 104b and a cylindrical inner end portion 104c. An inwardly tapering recess 106 is formed in the exterior surface of the tubing hanger C and on the inner end thereof developed into a cylindrical cavity 106a that is diametrically aligned with the second passage 60.

When the rod 104 is rotated in a clockwise direction as illustrated by the arrow 108 in FIG. 3, the rod 104 moved inwardly relative to the well head member B. As such inward movement takes place the cylindrical end portion 104c of the rod 104 pressure contacts inwardly tapering recess 106 and rotates the tubing hanger C relative to the well head member B in the direction of the arrow 110 shown in FIG. 3.

Rotation of the tubing hanger C in the direction of the arrow 110 due to the turning of the rod 104 results in the tubing hanger C being rotated to a position where the cylindrical inner end portion of the rod 104 may enter the cavity 106a, with the second cartridge D now being axially aligned with the first cartridge E, and the center line S extending therethrough as well as through the center of the rod 104 as shown in FIG. 4.

The first electrical conducting cartridge E may now be moved inwardly from the positions shown in FIGS. 3 and 6 to that illustrated in FIG. 4, wherein the first engaging electrical conductors 64a are engaged by the first engageable members 68. When such an engagement is achieved, the engagement is fluid tight as the resilient ring 66f is in sealing contact with the cylindrical section 60a shown in FIG. 6. The resilient sealing ring 66j is in abutting sealing contact with the surface 48c of the tubing hanger C. The collar G as shown in FIG. 4 has the threads 76b thereof in engagement with the threads 32a, and as the collar is tightened, the chevron packers 74 are compressed into sealing engagement between the external surface of the body 66, the bore 32, and body shoulder 66k, and the ring shaped end surface 76d of the collar G.

Prior to the engagement above described taking place, the connector J is moved upwardly for the second engageable members 64d to be engaged by the second engaging members 88 of the connector. This engagement is fluid tight, as the resilient sealing rings 84e are in sealing engagement with the cylindrical end section 58a in the tubing hanger C. The sealing ring 84g of the connector J are in sealing abutting contact with the bottom surface 46 of the tubing hanger C. The fastening plate 82 is moved upwardly into abutting contact with the lower surface of the rib 84b and the bolt 94 then tightened to hold the upper portion of the connector J within the confines of the end section 58*a* of the first passage 58.

The mounting flange 20 as shown in FIG. 1 has a centered vertically extending bore 112 therein that communicates with the interior of the christmas tree assembly 28. The bore 112 end mounting flange 20 develops on the lower thereof into an enlarged cylindrical section 112*a*. The section 112*a* is longitudinally aligned with the bore extension 50*c* formed in the tubing hanger C. The bore 112 and the enlarged cylindrical end portion 112*a* at their junction define a body shoulder 112*b*. The bore extension 50*c* as shown in FIG. 1 at the junction with the threaded portion 50*b* also defines a body shoulder 50*d*.

In FIG. 1 it will be seen that a tubular sleeve 114 is provided that has an upper ringed shaped end surface 114 and lower end surface 114*b*. The sleeve has an exterior surface 114*c* of cylindrical shape, and a bore 114*b* extending longitudinally through the sleeve. The exterior surface 114*c* has a pair of upper recesses 114*e* formed in the exterior surface 114*c* thereof as well as a pair of lower circumferentially extending recesses 114*f*. The upper recesses 114*e* serve to support a pair of resilient sealing rings 116, and the lower recesses similarly support a pair of lower sealing rings 118. In FIG. 1 it will be seen that the sleeve 114 is so disposed that the lower portion thereof extends into the bore extension 50*c*, with the lower sealing rings 118 sealingly engaging the bore extension 50*c*, with the lower end 114*b* of the sleeve 114 resting on the body shoulder 50*d* of the tubing hanger C. The upper portion of the sleeve 114 is disposed in the enlarged cylindrical end portion 112*a* of the bore 112 defined in the mounting flange 20, with the upper sealing rings 116 sealingly engaging the surface defining the enlarged cylindrical end portion 112*a*.

When it is desired to separate the components of the well head assembly A-1 the first electrical conducting cartridge E is moved outwardly to the position shown in FIG. 6 relative to the well head member B. The indexing device K is moved outwardly to the extent that it is free of the tubing hanger C. The upper rods 16 are now rotated in a direction to move outwardly free of the tubing hanger C. The fastening means 24 are now removed which permits the christmas tree array of valves 28, mounting flange 20, and sleeve 114 to be moved upwardly and away from the well head member B. The upper threads 50*b* of the hanger C may be engaged by a threaded member (not shown) on which an upward force may be exerted to lift the tubing hanger C above the well head member B, together with the tubing string 52, where connector J and cable H may be disconnected from the tubing hanger.

The casing hanger 40 may have the interior threaded portion 40*d* engaged by a threaded member (not shown) on which an upward force may be exerted to lift the casing hanger above the well head member D. The inner casing 42 will move upwardly with the casing hanger 40. Prior to the casing hanger 40 being moved upwardly the lower rods 18 are rotated to move them outwardly from engagement with the retaining ring 96. As the casing hanger 40 is moved upwardly in the well head member B, the retainer 96 will also be moved upwardly therewith.

When it is desired to reassemble the components, the procedure above described is simply reversed, and alignment of the first cartridge E with the second cartridge D being achieved by use of the indexing means K. The cable H will normally be banded to the tubing string 52 as the latter is lowered into the well, and sufficient slack is left in the cable H to permit the tubing hanger C to be moved above the well head member B without the cable H having a strain exerted thereon.

A second form A-2 of the well head assembly is shown in FIG. 2 and FIGS. 7 to 15 inclusive, and differs from the first form A-1 in that the second electrical conducting cartridge D′ is removably supported within the tubing hanger C′. Elements of the second form A-2 that are common to the first form A-1 are identified by the numerals and letters previously used, but with primes being added thereto.

Figure 7:
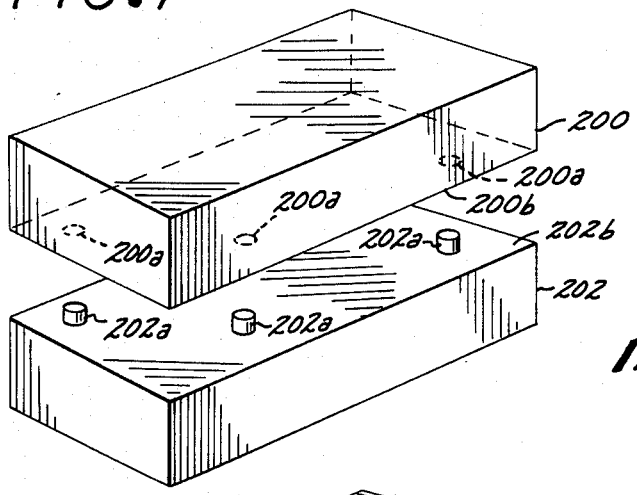
FIG. 7 is a perspective view of a pair of blocks of micarda like polymerized resin, with the lower block having prongs extending upwardly therefrom that engage recesses formed in the upper block to maintain the two blocks in a fixed position relative to one another.
Figure 11:
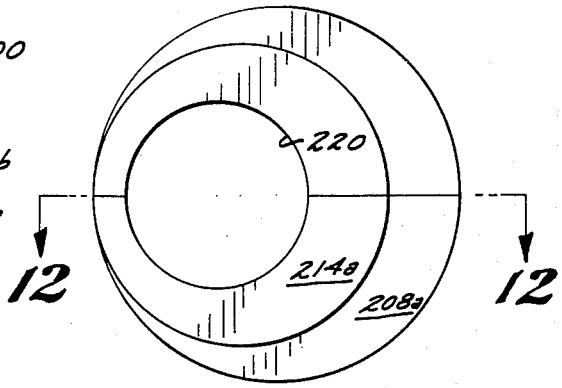
FIG. 11 is an end elevational view of the turned blocks that form a part of the second cartridge as shwon in FIG. 2.
Figure 8:
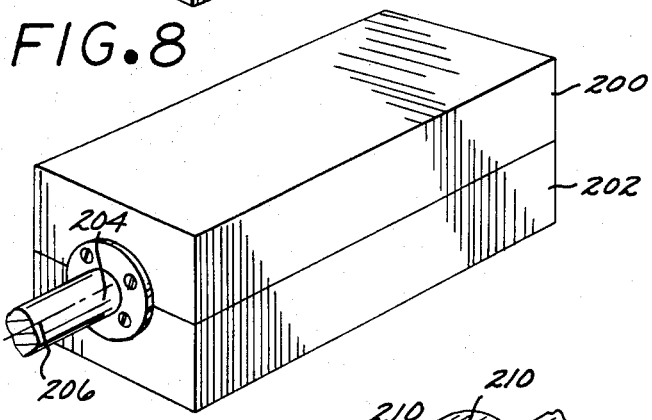
FIG. 8 is a perspective view of the blocks being supported in a centered position, for the right hand sections of the two blocks to be turned to a cylindrical configuration that has a pair of sealing ring supporting grooves defined therein.

The second electrical conducting cartridge D′ has a body 198 that is preferably defined by first and second rectangular blocks 200 and 202 formed from "Micarta" or a like material. The second block 202 has prongs 200*a* projecting upwardly therefrom as shown in FIG. 7 that engages recesses 200*a* formed in the first block 200. When the prongs and recesses are in engagement the side surfaces 200*b* and 202*b* of the blocks 200 and 202 are in abutting contact as shown in FIG. 8. A conventional fixture 206 rotates the blocks 200 and 202 as shown in FIG. 8 on a center line 204, and by a cutting member (not shown) the blocks are formed to have a cylindrical upper body portion 208. Also during the cutting operation a pair of grooves 210 are formed in the upper cylindrical body portion 208. The rotating fixture 206 is now moved to rotate the blocks on an off centered line 212, and by a cutting operation the body 198 has a lower cylindrical body portion 212 formed therein as well as a pair of circumferantially extending grooves 216.

Figure 12:
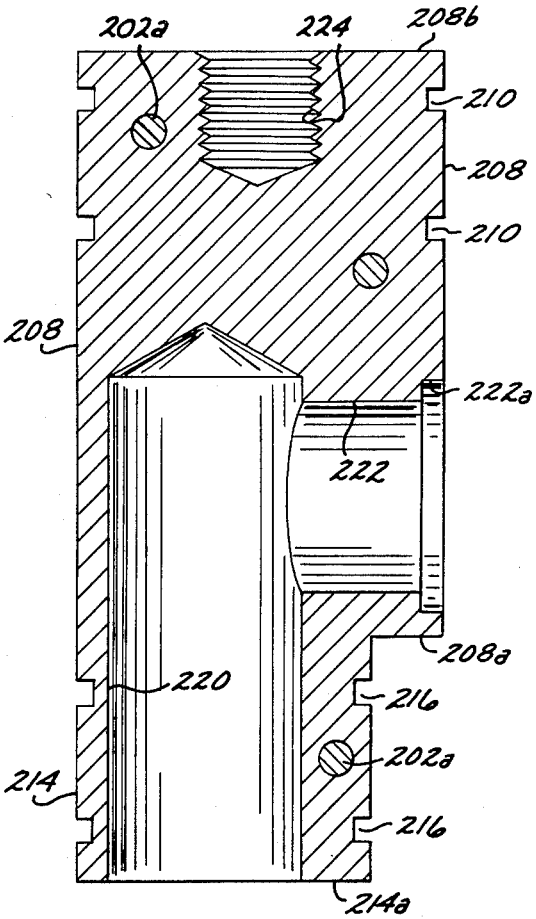
FIG. 12 is a longitudinal cross sectional view of the block that forms a part of the second cartridge that is removably mounted in the tubing hanger as shown in FIG. 2.
Figure 9:
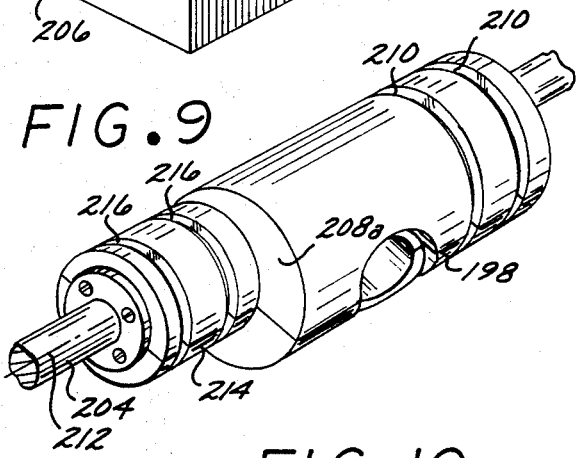
FIG. 9 is a perspective view of the blocks after the above described operation has been completed, with the block being rotatably supported in an off centered position to permit an off centered cylindrical end portion to be formed on the block by a turning operation.
Figure 10:
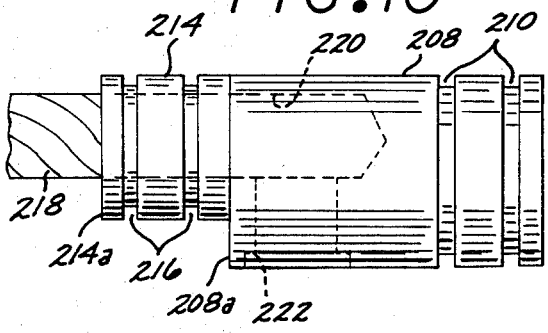
FIG. 10 is a side elevational view of the turned blocks, that are bonded together with the blocks being drilled both longitudinally and transversely to have first and second passages formed therein as illustrated in FIG. 2.

A drill 218 as shown in FIG. 10 is moved inwardly from the lower end 214*a* to form a first upwardly extending passage 220 in the body 198, and thereafter the drill is used to form a transverse passage 222, or as may be seen in FIG. 10 and more clearly in FIG. 12. The upper end 208*b* of the body 198 has a tapped recess 224 extending downwardly therein.

A cylindrical recess 222*a* is formed in the first and second blocks 200 and 202 at the outer end of the second passage 222. The first and second blocks 200 and 202 are now separated, and a body 226 defined by an electrical insulating material such as epoxy or the like is provided that is of such shape as to fill all of the first passage 220 and second passage 222 when the blocks are in the form shown in FIG. 15 and have the surfaces 200*b* and 202*b* in abutting contact.

Figure 14:
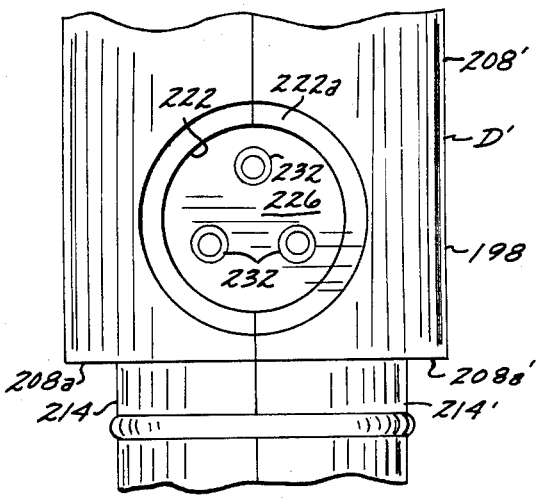
FIG. 14 is a fragmentary side elevational view of the block that forms a part of the second removably supported cartridge, and illustrating three electrical conducting sockets that are engageable by forwardly projecting prongs on the first cartridge.

The body 226 has a number of L-shaped electrical conductors 228 supported therein in spaced relationship. The conductors 228 have first engageable means, preferably in the form of prongs 230, that extend outwardly from the portion of the body 226 disposed in the first passage 222. The conductors 228 have second engageable means, preferably in the form of sockets 232, embedded in the body 226 as shown in FIGS. 14 and 15.

Figure 13:
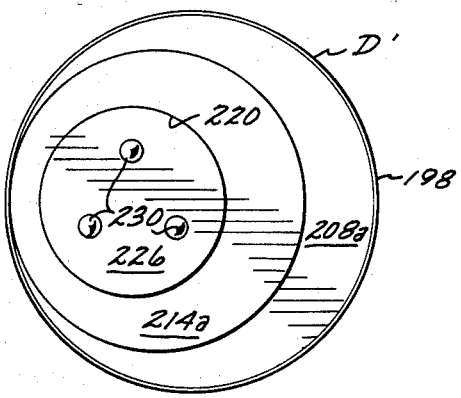
FIG. 13 is an end elevational view of the second cartridge of the removable type shown in FIG. 2, with three electrical conducting prongs projecting outwardly from the off centered end portion thereof.
Figure 15:
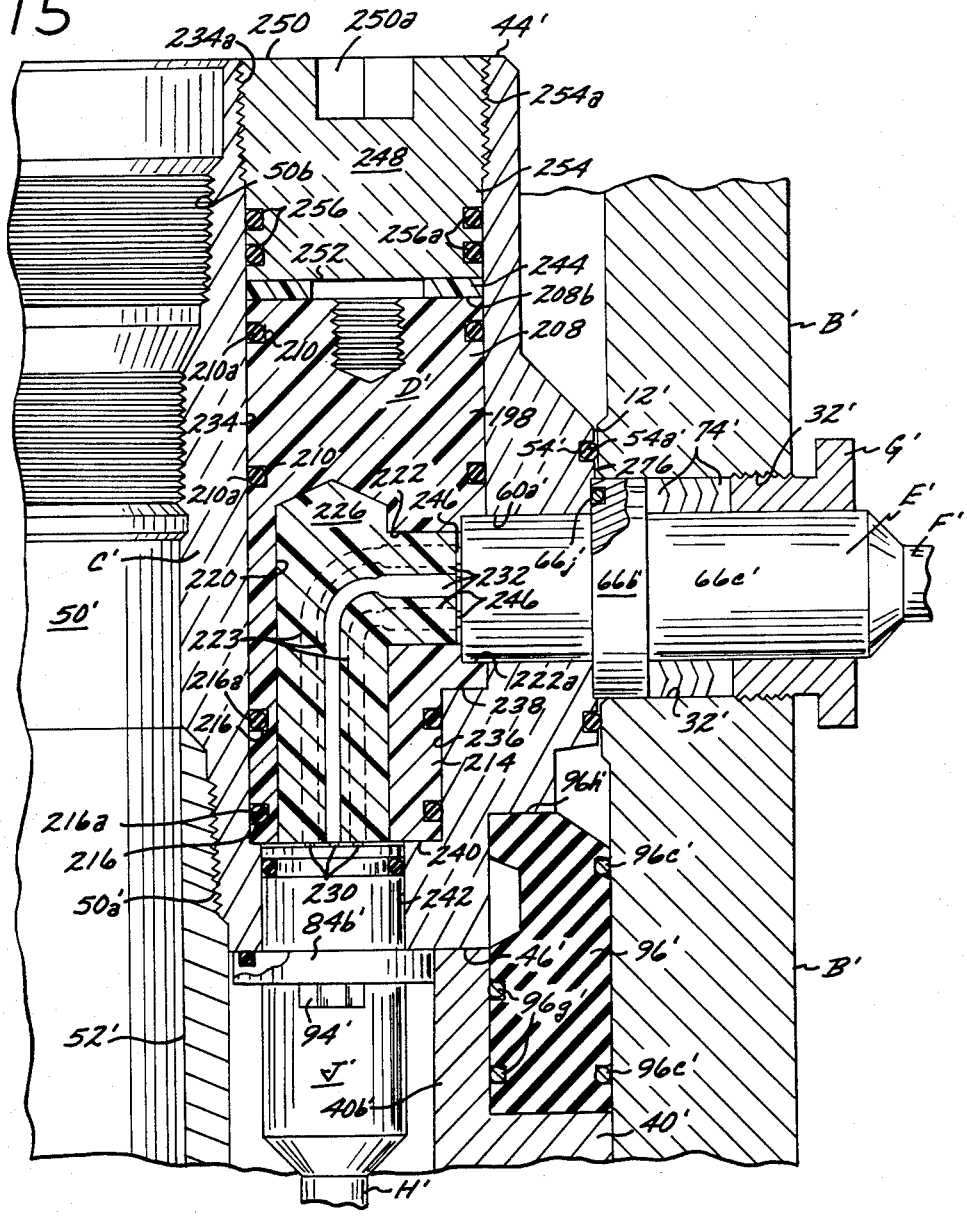
FIG. 15 is a fragmentary vertical cross sectional view of the second cartridge removably supported in the tubing hanger and in engagement with a first cartridge removably and sealingly supported in the transverse bore of the tubular well head member.

The side surfaces 200*b* and 202*b* are now bonded together in abutting contact by an adhesive or the like to define the first electrical conducting cartridge D′ as may be seen in FIG. 15 which has the cylindrical body 198 defined by the shaped blocks 200 and 202. The prongs 230 are shown in FIG. 13. Likewise, the sockets 232 are illustrated in FIG. 14.

Figure 2:
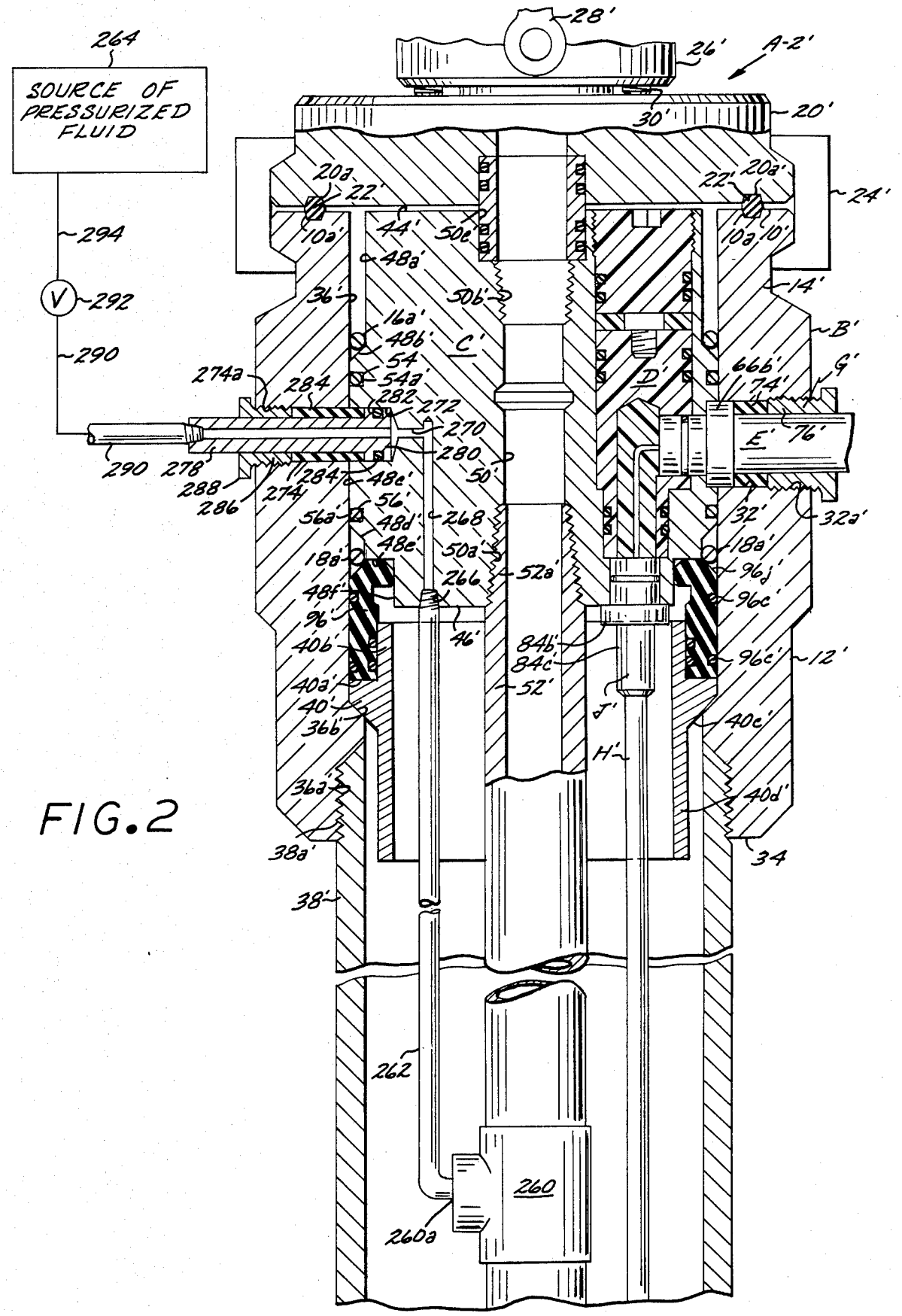
FIG. 2 is a longitudinal cross sectional view of a second form of the well head assembly, in which the tubing string has a normally open pressure actuateable valve therein, and in this form of the assembly the valve may be actuated by fluid under pressure that flows from a source thereof to a confined space defined between the well head member and tubing hanger support to a conduit that extends downwardly to the valve.

In FIGS. 2 and 15 it will be seen that a first bore 234 extends downwardly from the top 44′ of the tubing hanger C′ and develops into an off centered downwardly extending second bore 236, which first and second bores at their junction define a transverse crescent shape body shoulder 238. The second bore 236 at the lower end thereof terminates in a body shoulder 240 from which a bore extension 242 extends towards the bottom 46' of the tubing hanger C. The body shoulder 238 as shown in FIG. 15 is situated below the second passage 68'.

The cartridge D' may now be slid downwardly in the first bore 234 as shown in FIG. 15, with the lower portion of the cartridge being disposed in the second bore 236, and the second passage 222 being axially aligned with the passage 60a' formed in the tubing hanger C'. The grooves 210 and 216 support sealing rings 210a and 216a that removably seal with the first bore 234 and second bore 236 as shown in FIG. 15. A sealing ring 244 rests on the upper surface 208b of the body 198 as may be seen in FIG. 15.

A first cartridge E' is provided that has the same general structure as the first cartridge E, but with the sockets 68 of the first cartridge being omitted. The sockets 66d of first cartridge E are replaced in first cartridge E' as may be seen in FIG. 15 by electrical conducting prongs 246 that may slidably engage the sockets 232. When the tubing hanger D' is rotated relative to the well head member B' as shown in FIG. 15 where the cylindrical passage 60a' is co-axially aligned with the transverse bore 32', the first cartridge E may be moved inwardly through the transverse bore 32' for the prongs 246 to engage the sockets 232. The forward portion of the first electrical conducting cartridge E', will then be disposed in the cylindrical end section 60a' and extend into the cylindrical recess 222a as shown in FIG. 15. The collar G' when screwed inwardly to the position shown in FIG. 15 compresses the sealing rings 74' into sealing engagement with the first electrical conducting cartridge E' and the well head member B'.

The second electrical conducting cartridge D' is removably held in the seated position shown in FIG. 15 in the tubing hanger C' by a cylindrical plug 248 that has a top 250, bottom 252 and sidewall 254. Plug 248 has threads 254a formed on the upper portion of the sidewall 254, which threads engage the threads 234a in the tubing hanger C'. A non-circular wrench engageable cavity 250a extends downwardly in the plug 248 to permit the plug to be rotated and removably disposed in the position shown in FIG. 15 where it exerts a downward force on the sealing ring 244 and the second electrical conducting cartridge C'. Sidewall 254 has a pair of spaced circumferantially extending grooves 256 formed therein that support sealing rings 256a that seal with the first bore 234.

An internally threaded cavity 256 extends downwardly in second electrical conducting cartridge D' from the end surface 208b, with the cavity being engageable by a threaded rod (not shown) to lift the second cartridge from the tubing hanger C' after the plug 248 and sealing ring have been removed from the tubing hanger C'. The connector J' shown in FIG. 15 is of the same structure as connector J. Connector J' removably engages the prongs 230, and when so engaged supplies electric power from cable F' to cable H'.

The tubing string 52' in FIG. 2 is illustrated as being a normally open valve 260 interposed therein, which valve is placed in the closed position by a pressurized fluid being applied to the port 260a therein. A source of pressurized fluid 264 is provided for actuating the valve 260 when it is desired to place the latter in a closed position. Tubing 262 extends upwardly from the port 260a to engage a recess 266 that extends upwardly from the bottom surface 46' of the tubing hanger C' as shown in FIG. 2.

The tubing hanger C' has an upwardly extending bore 268 formed therein in communication with the recess 266, and the upwardly extending bore being intersected by a horizontal bore 270. The two sealing rings 54a' and 56a' as may be seen in FIG. 15 pressure contact the interior surface of the well head member B' and cooperate with the well head member and the surface 12' of the tubing hanger to define a thin annulus shape confined space 276 therebetween.

The horizontal bore 270 on the outer end thereof develops into a cylindrical cavity 272 that is co-axially aligned with a second transverse bore 274 formed in the well head member B', with the cavity and second bore 274 being co-axially aligned when the first electrical conducting cartridge E' is in engagement with the first electrical conducting cartridge C' as shown in FIG. 2. The second bore 274 has threads 274a defined on the outer portion thereof.

A tubular member 278 is provided that has a cylindrical head 280 on the inner end thereof as illustrated in FIG. 2, which head has a groove 282 extending circumferentially there around and in which a sealing ring 284 is mounted. An externally threaded tubular collar 286 is shown in FIG. 2 that threadedly engages the threads 274a, and the collar having a wrench engageable outer end 288. The outer end of the tubular member 278 is connected to a length of tubing 290 that extends to the discharge port of a valve 292 which valve is normally in the closed position, but is adapted by hand operated means (not shown) to be moved to the open position. The fluid inlet to the valve 292 is connected by tubing 294 to the source of pressurized fluid.

Sealing rings 284a encircle the portion of the tubular member 278 between the head 280 and the inner end of the collar 286.

When the collar is rotated in an appropriate direction the sealing rings 284a are compressed, and are forced into pressure sealing contact with the head 280, the surface defining the cavity 272 in the tubing hanger C', and the surface of the well head member B' that defines the bore 274. In an emergency, the valve 292 may be placed in the open position to permit pressurized fluid to flow from the source 264 to the valve 260 to close the same, and prevent undesired fluid from discharging upwardly through the bore 50' to the christmas tree assembly of valves 28'.

The well head assembly A-2 as above described supplies electric power to the cable H' in the same manner as the assembly A-1, but differs from the assembly A-1 in that the second cartridge C' is removable from the supporting tubing hanger C'.

In both the forms A-1 and A-2 of the well head assembly, the well head assemblies 28 and 28' are mounted directly thereon and accordingly have a minimum vertical profile, the tubing strings 52 and 52' are supported at centered positions within the well bore, and electric power is supplied to the well head assemblies below the upper ends thereof.

The use and operation of the invention has been described previously in detail and need not be repeated.

What is claimed is:

1. In combination with a well head situated above a bore hole in which a tubing string is situated that is connected to a downhole electric motor driven pump, said tubing string having a threaded upper end; a pressurized fluid actuated device in said bore hole; tubing that extends upwardly in said bore hole from said device, said tubing and tubing string having upper ends; an electrical conducting connector; an electrical conducting cable that extends downwardly in said bore hole from said connector to said electric motor driven pump; a first elongate electrical conducting cartridge connected to a source of electric power, said first cartridge and said connector having first and second electrical conducting engaging means thereon; an elongate tubular member in communication with a source of pressurized fluid; said well head including a generally cylindrical side wall that has first and second circumferentially spaced, transverse, bores therein and support means that extend inwardly from said side wall; a tubing hanger assembly disposed in said well head and rotatably resting on said support means, said tubing hanger assembly concurrently supporting said tubing string in a centered position in said bore hole, establishing pressurized fluid communication between said elongate tubular member and tubing, and removably supporting an electrical connection between said first electrical conducting cartridge and said connector that may be replaced while said tubing hanger remains in place in said well head, said first electrical conducting cartridge and elongate tubular member including first end portions that are disposed within said first and second transverse bores when said first electrical conducting cartridge and elongate tubular member are in first positions and extend into said well head when said first electrical conducting cartridge and elongate tubular member are moved to second positions, said tubing hanger assembly including:

a. a generally cylindrical rigid body that includes top and bottom surfaces and a side surface that extends therebetween, said body disposed in said well head and rotatably resting on said support means, a centered vertically extending passage in said body that includes a lower threaded end portion that is engaged by said threaded upper end of said tubing string, a first bore that extends downwardly in said body from said top surface to develop into a laterally offset second bore in smaller diameter, said first and second bores at a junction thereof defining a first transverse body shoulder, a first transverse passage in said body that extends from said first bore to said side surface; a third bore in said body that extends upwardly from said bottom surface to develop into a second transverse passage that is in communication with a cavity that extends inwardly from said side surface, said first bore defining threads in the upper portion thereof, said first and second transverse passages circumferentially spaced at the same angle as said first and second transverse bores and centered in a common horizontal plane therewith;

b. a second electrical conducting cartridge that includes a body of an electrical insulating material that has an upper elongate portion and a lower laterally offset portion depending therefrom said upper and lower portions defining a second horizontal body shoulder at their junction, said upper and lower portions removably and slidably disposed in said first and second bores, first and second connected electrical conducting engageable means supported by said body of electrical insulating material as to be removably engaged by said first and second engaging means when axially aligned therewith when said first body shoulder rests on said second body shoulder, with said upper portion of such length as to be situated below said threads in said first bore when said second electrical conducting cartridge is disposed, and said body of electrical insulating material being insertable into said first and second bores only when rotated to a first position in which said first electrical conducting engaging and engageable means lie in common vertical planes;

c. an externally threaded plug that removably engages said threads in said first bore, said plug when rotated in a direction to move downwardly in said first bore forcing said second electrical conducting cartridge into abutting contact with said second body shoulder;

d. first means for securing said electrical connector to said bottom surface of said tubing hanger body in a position where said second electrical conducting engaging means engage said second electrical conducting engageable means when said body of electrical insulating material rests on said second body shoulder;

e. second means for securing said tubing to said tubing hanger body in communication with said third bore; and f. manually operated indexing means for rotating said tubing hanger body relative to said well head to concurrently radially align said first and second transverse bores with said first and second transverse passages to permit said first electrical conducting cartridge and elongate tubular member to be moved from said first to said second positions to establish an electrical circuit to said motor and communication between said elongate tubular member and said tubing connected to said pressurized fluid actuated device.

2. A tubing hanger assembly as defined in claim 1 which in addition includes a wrench engageable opening in said plug for rotating said plug into and out of said first bore and a threaded cavity in said second electrical conducting cartridge that may be removably engaged by a threaded rod to lift said second electrical conducting cartridge from said tubing hanger body when said plug has been removed and said first electrical conducting cartridge moved from said second to said first positions.

3. A tubing hanger assembly as defined in claim 1 which in addition includes:

g. manually operated third and fourth means for selectively moving said first electrical conducting cartridge and said elongate tubular member to either said first or second positions.

4. A tubing hanger assembly as defined in claim 1 which in addition includes:

g. first resilient sealing ring means on the exterior surface of said plug that pressure contact the material defining the first bore in said tubing hanger body; and h. second and third resilient sealing ring means on the exterior surfaces of said upper and lower portions of said body of electrical insulating material that pressure contact the material defining the first and second bores in said tubing hanger body to prevent moisture reaching said first electrical conducting engaging and engageable means.

5. A tubing hanger assembly as defined in claim 4 which in addition includes:

i. fourth and fifth resilient sealing ring means that encircle said tubing hanger body and pressure contact said cylindrical side wall of said well head above and below said first passage to further prevent moisture reaching said first electrical conducting engaging and engageable means.

6. A tubing hanger assembly as defined in claim 4 which in addition includes:

i. fourth and fifth resilient sealing means on said first electrical conducting cartridge and said connector that pressure contact said tubing hanger body to further prevent moisture reaching said first and second electrical conducting engaging and engageable means.

7. A tubing hanger assembly as defined in claim 1 in which said manually operated indexing means is:

g. a threaded rod rotatably supported in a tapped transverse bore in said well head, said rod having an inner end and a wrench engageable outer end, and an inwardly tapering recess in said tubing hanger body that may be engaged by said inner end of said rod, with said recess so located that when said inner end of said rod is in full engagement therewith said tubing hanger has been rotated to a position where said first and second passages are in radial alignment with said first and second transverse bores.

8. An electrical conducting well head assembly of the type that includes a tubular well head situated above a bore hole in which a string of tubing is disposed that is connected to an electric motor driven downhole pump; an electric cable extending upwardly from said pump in said bore hole; a first electrical conducting cartridge slidably mounted in a transverse bore in said well head, said first cartridge including first electrical conducting engaging means that are disposed within said well head when said first cartridge is moved from a first uncoupled position to a second coupled position; an electrical conducting connector secured to said cable and adjacently disposed to said tubular well head, said connector including second electrical conducting engaging means; support means in said well head, said well head assembly being characterized by including:

a. a tubing hanger in the form of a generally cylindrical body that has top and bottom surface and a connecting side surface, said tubing hanger rotatably resting on said support means within said well head and supporting said tubing string in communication with a vertical passage that extends upwardly therethrough, a first vertical bore that extends downwardly in said body from said top surface to communicate with a second vertical bore that is laterally offset from said first bore and of smaller diameter and that extends to said bottom surface, said first bore having threads defined in the upper portion thereof and a transverse passage in said body that communicates with said first bore, said first and second bores at their junction defining a horizontal body shoulder;

b. first means for supporting said electrical conducting connector from said bottom surface with said second electrical conducting engaging means vertically aligned with said second bore;

c. a second electrical conducting cartridge in the form of a body of electrical insulating material that includes a second body shoulder, first and second connected electrical conducting engageable means on said body of electrical insulating material, said body of electrical insulating material slidably and snuggly engaging said first and second bores, said first electrically conducting engaging and engageable means lying in the same horizontal planes when said second body shoulder is in abutting contact with said first body shoulder, and said body of electrical insulating material when so disposed having said second electrical conducting engaging and engageable means in engagement, said body of electrical insulating material having a top surface situated below said threads;

d. an externally threaded plug that engages said threads in said first bore to force said first and second body shoulders into abutting contact;

e. indexing means for rotating said tubing hanger relative to said well head when said first cartridge is in said first position to axially align said first passage and transverse bores whereupon said first cartridge may be moved to said second position for said first electrical conducting engaging means to engage said first electrical conducting engageable means:

f. wrench engageable means on said plug for rotating the latter relative to said tubing hanger; and g. first means on said body of electrical insulating material for lifting the latter out of said tubing hanger for repair or replacement when said plug is removed and said first cartridge is in said first position.

9. An electrical conducting well head assembly as defined in claim 8 which in addition includes:

h. first resilient sealing means that encircle said second electrical conducting cartridge above and below said first electrical conducting engageable means that pressure contact the material of said tubing hanger defining said first vertical bore to prevent moisture entering said first vertical bore to reach said first electrical conducting engageable means to corrode the latter.

10. An electrical conducting well head assembly as defined in claim 9 which in addition includes:

i. second resilient sealing means that encircle said plug and pressure contact the material of said tubing hanger defining said first vertical bore to prevent moisture from moving downwardly in said first vertical bore below said plug.

11. An electrical conducting well head assembly as defined in claim 8 which in addition includes:

h. first means on said plug for retrieving it from said first vertical bore.

* * * * *